US007812533B2

(12) United States Patent
Johnston et al.

(10) Patent No.: US 7,812,533 B2
(45) Date of Patent: Oct. 12, 2010

(54) MERCURY DISPENSER, METHOD OF MAKING MERCURY DISPENSER AND METHOD OF DOSING MERCURY INTO ARC DISCHARGE LAMP

(75) Inventors: David W. Johnston, Kensington, NH (US); William A. George, Lynn, MA (US); Richard S. Speer, Concord, MA (US); Gregory Zaslavsky, Marblehead, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 248 days.

(21) Appl. No.: 11/983,626

(22) Filed: Nov. 9, 2007

(65) Prior Publication Data

US 2009/0121610 A1 May 14, 2009

(51) Int. Cl.
*H01J 17/26* (2006.01)

(52) U.S. Cl. ..... 313/565; 313/639; 313/490; 313/571

(58) Field of Classification Search ..... 313/565, 313/639, 490, 571
See application file for complete search history.

(56) References Cited

U.S. PATENT DOCUMENTS

| | | | | |
|---|---|---|---|---|
| 6,650,041 | B1 | 11/2003 | Speer et al. | 313/490 |
| 6,653,775 | B1 | 11/2003 | Speer et al. | 313/490 |
| 6,784,609 | B2 | 8/2004 | Speer et al. | 313/490 |
| 6,891,323 | B2 | 5/2005 | Lima et al. | 313/490 |
| 6,905,385 | B2 | 6/2005 | Speer et al. | 445/53 |
| 6,906,460 | B2 * | 6/2005 | Busai et al. | 313/565 |
| 6,913,504 | B2 | 7/2005 | Zaslavsky et al. | 445/53 |
| 2001/0038264 | A1 * | 11/2001 | Brumleve et al. | 313/565 |
| 2004/0041515 | A1 | 3/2004 | Speer et al. | |
| 2004/0104665 | A1 | 6/2004 | Speer et al. | |

FOREIGN PATENT DOCUMENTS

| | | |
|---|---|---|
| EP | 0 568 317 | 11/1993 |
| EP | 0 809 276 | 8/2001 |

* cited by examiner

*Primary Examiner*—Nimeshkumar D Patel
*Assistant Examiner*—Christopher M Raabe
(74) *Attorney, Agent, or Firm*—Shaun P. Montana

(57) ABSTRACT

A fluorescent lamp (10) includes a tubular member or envelope (12) having an arc generating and sustaining medium (15) therein. As known, the tubular envelope (12) is constructed of a suitable glass, for example lime glass. An electrode (14) is provided in each end of the tubular member (12) and a phosphor coating (16) is applied to the interior surface (18) of the tubular member (12). A mercury dispenser (20) is situated within the tubular member (12). The mercury dispenser (20) includes a body (21) composed of a material selected from the group consisting of glass and ceramic materials. The body (21) is provided with a bore (22). A first material (24) capable of wetting mercury coats the bore. In a preferred embodiment the first material (24) is silver having a thickness between 0.1μ and 8μ. A quantity of mercury (26) is deposited in the bore (22) in contact with the first material (24).

16 Claims, 3 Drawing Sheets

MERCURY DISPENSER, METHOD OF MAKING MERCURY DISPENSER AND METHOD OF DOSING MERCURY INTO ARC DISCHARGE LAMP

TECHNICAL FIELD

This invention relates to arc discharge lamps and more particularly to fluorescent lamps. Still more particularly, it relates to mercury dispensers for such lamps, methods of dosing mercury into such lamps and methods of making the mercury dispensers.

BACKGROUND ART

Fluorescent lamps require mercury to operate. Because of mercury's perceived environmental problems, recent regulatory controls impose lower and lower mercury dosing in fluorescent lamps. As these doses decrease, they approach the minimum dose required to operate the lamp over its projected lifetime. It has proven to be very difficult to accurately maintain the very small doses necessary to meet environment constraints while ensuring consistent lamp quality and life.

Fluorescent lamps have been (and still are) dosed with a variety of techniques. Liquid dosing is the simplest and least expensive method; however, it is very inaccurate and virtually impossible at doses lower than 4.5 mg, especially when lamps are processed on high-speed equipment.

In attempts to solve the dosing or dispensing of mercury, industry has used a variety of glass and metal capsules. These techniques offer several advantages, for example, the accuracy and size of the dose is only limited by the mercury metering and delivery equipment used to place the mercury in the capsule. Since these techniques can be run off-line at a separate facility, slow and accurate filling methods can be employed. However, the disadvantages include the fact that the capsules must be mounted on a structure within the lamp, thus adding to the cost and complexity. Further, the capsule must be opened within the lamp after the lamp has been evacuated and the exhaust tube sealed, adding a processing step and the potential for additional lamp failures.

Additional procedures have used the placement within the lamp of a strip of material containing a titanium/mercury alloy that decomposes at temperatures near 900 degrees C. However, the variation in mercury dose from strip to strip is large enough that dosing at amounts less than 2.5 mg is not practical. Also, like the capsules, the strip must be mounted within the lamp in a predictable manner and be activated by an external radio frequency field.

Recently, it has been proposed (U.S. Pat. Nos. 6,905,385 and 6913,504) that dosing could be accomplished by coating a steel ball with silver and subsequently applying mercury to the silver coating. While this technique provides relatively accurate control over the amount of mercury, it has been found that if the steel ball remains loose in the lamp, it causes damage to the phosphor coating. Further, after manufacture, it is necessary to keep the mercury/silver coated balls separated since it has been found, through testing, that allowing the balls to come into contact with one another allows for the transfer of mercury between them, thus destroying the necessary accuracy for dosing requirements.

DISCLOSURE OF INVENTION

It is, therefore, an object of the invention to obviate the disadvantages of the prior art.

It is another object of the invention to enhance fluorescent lamps.

Still another object is a method of accurately dosing mercury into fluorescent lamps.

These objects are accomplished, in one aspect of the invention, by a mercury dispenser for fluorescent lamps, the mercury dispenser comprising a body in the form of a bead whose material is selected from the group consisting of glass and ceramic; a bore in the body, a first material coating the bore, the material being capable of wetting mercury; and a quantity of mercury in the bore contacting the first material. In another aspect of the invention a method of dispensing mercury into a fluorescent lamp is provided, the method comprising the steps of providing a body selected from the group consisting of glass and ceramic materials, providing a bore in the body; providing a first material as a coating in the bore, the material being capable of wetting mercury; depositing a quantity of mercury within the bore in contact with the first material; inserting the body into a fluorescent lamp via a lamp exhaust tubulation; exhausting and sealing the lamp, and processing the lamp to activate same. In yet another aspect of the invention a method of making a mercury dispenser comprises the steps of forming a body of a material selected from the group of glass and ceramic materials; providing a bore in the body; coating the bore with a mercury wetting material and dispensing a quantity of mercury into the bore. And in still another aspect of the invention a fluorescent lamp is provided, the lamp comprising a tubular member having an arc generating and sustaining medium therein; an electrode at each end of the tubular member; a phosphor coating on the interior of the tubular member, and a body formed of a material selected from the group of glass and ceramic contained with the tubular member, the body having a bore therein, the bore being coated with a mercury wetting material and a quantity of mercury within the bore in contact with the mercury wetting material.

The low mass of the glass or ceramic body does not adversely affect the phosphor coating and the bodies can be shipped in contact with one another without affecting the quantity of mercury. The mercury dosage can be very accurately controlled and the mercury can be loaded into the bodies easily.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
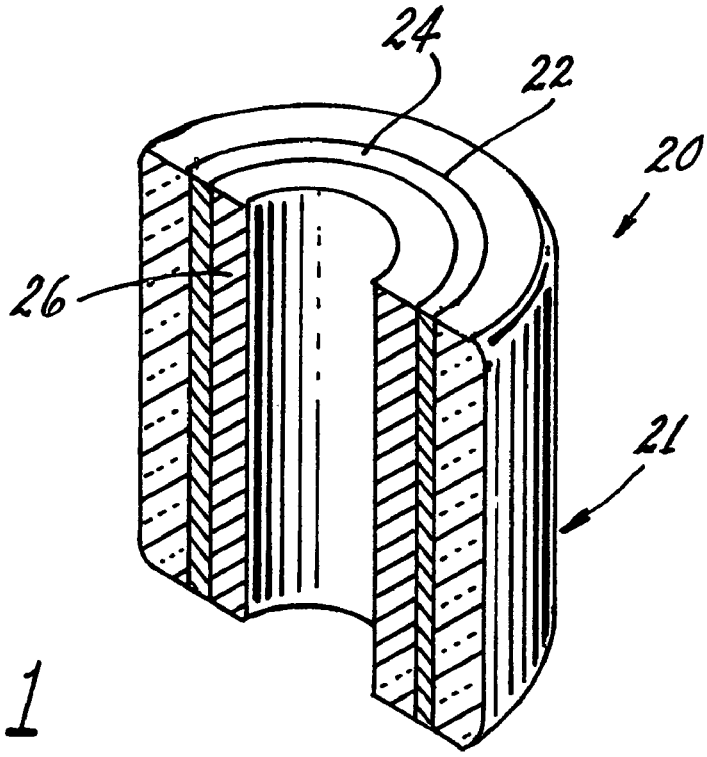
FIG. 1 is a sectional view of an embodiment of the invention.
Figure 2:
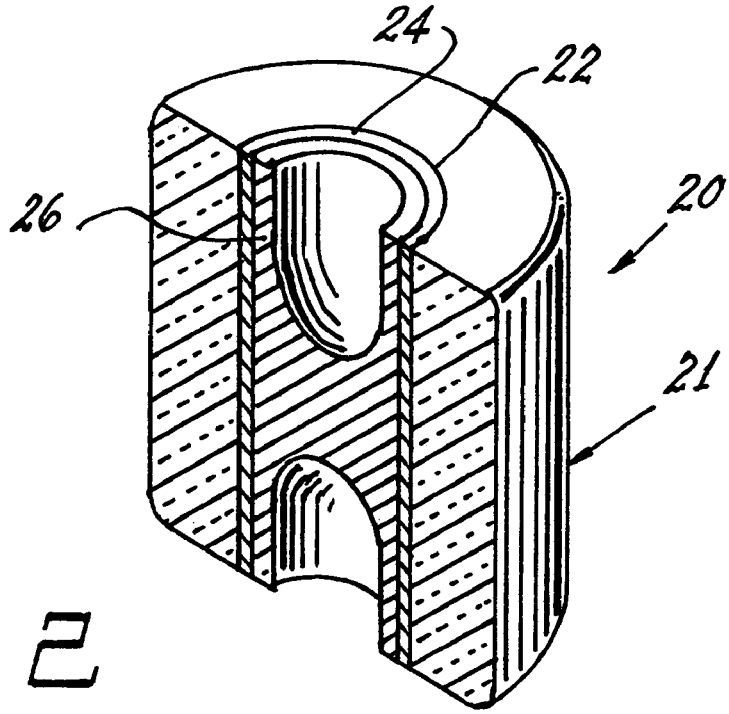
FIG. 2 is a sectional view of another embodiment of the invention.
Figure 3:
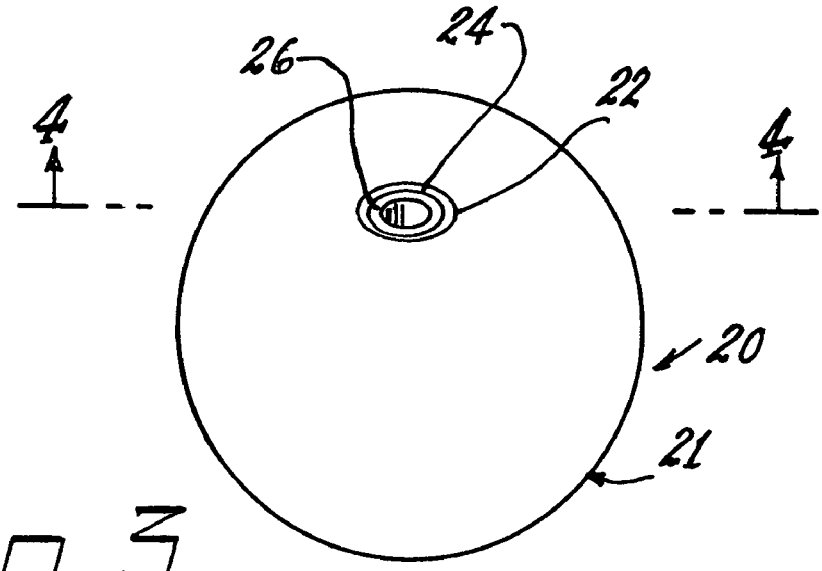
FIG. 3 is a perspective view of an embodiment of the invention.
Figure 4:
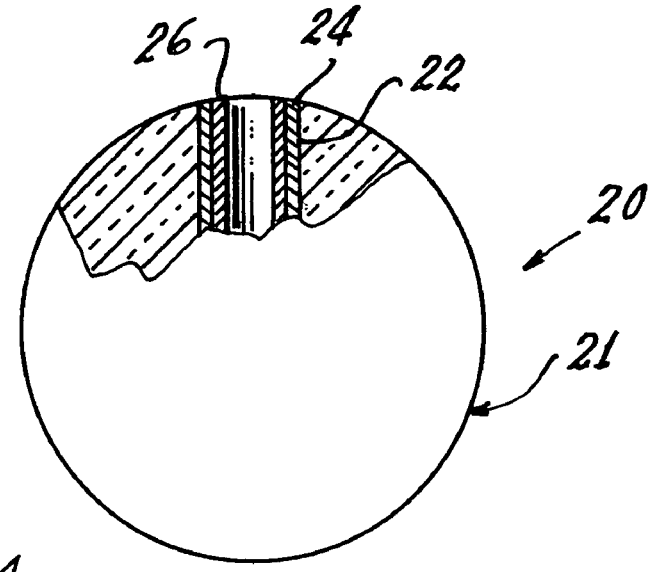
FIG. 4 is a partial sectional view taken along the line 4-4 of FIG. 3.

Referring now to the drawings with greater particularity, there is shown in FIG. 1 a mercury dispenser 20 for an arc discharge lamp, such as fluorescent lamp 10. The mercury dispenser 20 comprises a body 21 composed of a material selected from the group consisting of glass and ceramic materials. A suitable glass can be lime glass, lead glass or a borosilicate glass; however, a lime glass in preferred as that is the material used for the tubular glass envelope. A suitable ceramic is steatite or a similar material. The body 21 can be substantially cylindrical, as shown in FIGS. 1 and 2, or spherical, as shown in FIGS. 3 and 4. Preferably, the body 21, if cylindrical, has a length of 1.6 mm with a diameter of 1.1 mm and if spherical, a diameter of 1.6 mm. The body 21 is provided with a bore 22 having a diameter of 0.7 mm. A first material 24 capable of wetting mercury coats the bore 22. In a preferred embodiment, the first material is silver having a thickness between 0.1μ and 8μ; however, other materials capable of wetting mercury, such as those selected from the group of gold, tin, lead, bismuth, zinc, copper, antimony, iron and alloys thereof can also be employed. A quantity of mercury 26 is deposited in the bore 22 in contact with the first material 24. While the amount of mercury will be dependent upon the size of the body 21 and bore 22, as well as the amount necessary for lamp operation, such as amounts between 0.5 and 3.5 mg, inclusive; however, other amounts can be utilized as shown by TABLE I, below.

TABLE I

| Body | Ag Layer cm | Inner Dia. cm | Length cm | Weight Ag mg | Max. Hg dose mg |
|---|---|---|---|---|---|
| Type 1 | $1 \times 10^{-5}$ | 0.07 | 0.106 | 0.0034 | 4.2 |
| Type 2 | $1 \times 10^{-5}$ | 0.09 | 0.14 | 0.0074 | 9.3 |
| Type 3 | $1 \times 10^{-5}$ | 0.07 | 0.13 | 0.0035 | 4.3 |
| Type 4 | $1 \times 10^{-5}$ | 0.06 | 0.15 | 0.0034 | 4.2 |

In TABLE I the maximum mercury dose per dispenser 20 is based on a 50° C. solubility of silver in mercury.

Figure 5:
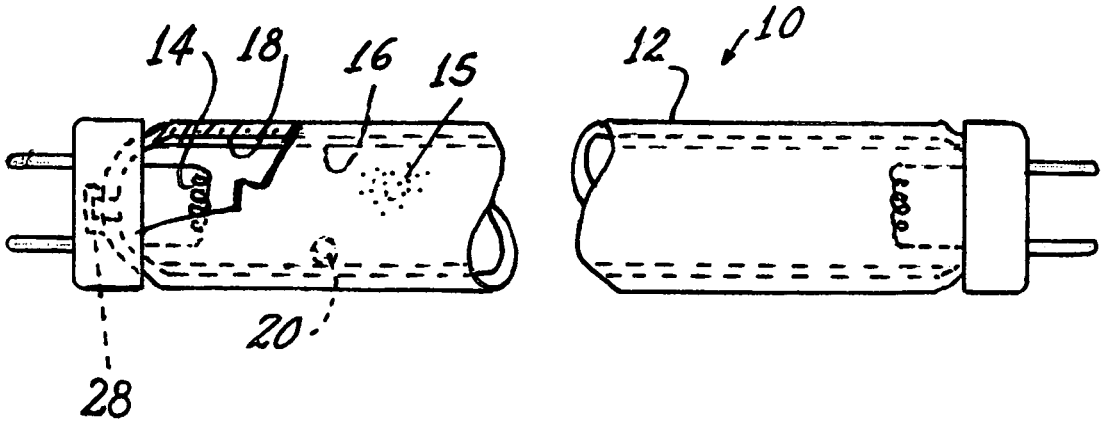
FIG. 5 is an elevation view, partially in section, of a fluorescent lamp in accordance with an embodiment of the invention.

A fluorescent lamp 10, according to an embodiment of the invention and as shown in FIG. 5, comprises a tubular member or envelope 12 having an arc generating and sustaining medium 15 therein. As known, the tubular member 12 is constructed of a suitable glass, for example, lime glass. An electrode 14 is provided at each end of the tubular member 12 and a phosphor coating 16 is applied to the inner surface 18 of the tubular member 12. A mercury dispenser 20 is situated within the tubular member 12.

Ideally, the mercury dispenser 20 is inserted into the tubular member 12 via the exhaust tubulation 28 and the lamp 10 is then processed normally. Tests have shown that the inserted dispenser 20, unlike those comprised of steel bearings, has no deleterious effects on the phosphor coating 16, even during normal packaging and shipping, primarily due to the much lower mass of the glass body when compared to the steel bodies. Tests of prior art silver coated steel balls with a diameter of 2.5 mm and a layer of mercury at 4.0 mg, had a mass of 64 mg, and lamps in which they were used showed significant removal of phosphor one of the lamp ends after normal shipping and handling. In contrast, the glass mercury dispensers 20 of the instant invention had an average mass of 5 mg without the insertion of mercury, which could add up to 5 mg of additional material.

Several methods of dosing the mercury into the dispensers 20 are available, but the preferred approach is to employ a precision ceramic pump designed for dosing micro quantities of liquid, often used in the medical supply field. One such device is known by the name IVEK and is commercially available. When the latter is utilized, the requisite amount of mercury is placed upon a flat plate and the bore of the body or bead 21 is placed over the mercury drop. The mercury is pulled into the bore 22, leaving no residue behind. Alternatively, a needle from such a micro-dosing pump can be inserted into the bore of the bead and the mercury dispensed thereinto.

Glass beads 21 of the type described herein are commercially available as children's toys, used for the purpose of stringing them together for making necklaces and/or bracelets or the like. When these beads arrive from the manufacture it is often found that the silver lining is covered with an acrylic material and it is necessary to remove this acrylic material before dosing with mercury. One method used to remove the acrylic material was submerging and agitating the beads in acetone for a time sufficient to remove the acrylic coating. Another method involves heating the beads in flowing hydrogen at 475° C. for one hour.

These glass beads or bodies 21 can be used to deliver various doses of mercury into fluorescent lamps. For example, the solubility of silver in mercury at 50° C. is 0.08% by weight. Employing a safety factor of two, the maximum dose of mercury, for a bead with 0.0074 mg of silver, with respect to the solubility of silver, is 4.6 mg. However, the other limit on dose size is related to the adhesion between the mercury and the silver layer and the forces the beads will experience between mercury dosing and dispensing into the lamp. This limit is determined by dosing and dispensing processes and equipment used. The minimum amount of mercury that can be dosed with this bead would be 0.017 mg greater than the amount of mercury needed to run the lamp to the end of its rated life. This is based on the silver weighing 0.0074 mg and the requirement that the ratio of mercury to silver remain above 7:3 for the entire life of the lamp. Thus, the practical limit to dosing with this bead is related to the precision with which the mercury can be delivered to the bore of the bead.

Another important aspect of this type of construction is the ability of the mercury to remain within the bore. This can also be a function of the roughness of the silver layer (which, of course, can be based on the roughness of the bore surface). It has been found that an average surface roughness of 1.2μ is acceptable; however, an average surface roughness of 3μ is preferred.

In a subsequent test that included the manufacture of the beads themselves, a 300 mm long borosilicate tube having an outer diameter of 2 mm with a bore of 1.3 mm was coated on the bore with a commercially available silver paste. The paste comprised a silver powder and 5% lead glass frit with terpineol and ethyl cellulose as binders. This paste was thinned with ethylene glycol monopropyl ether in a ratio of 3:1 to lower its viscosity. The coating was dried at 60° C. until flow was undetectable and then at 100° C. for 12 hours to remove the terpineol. The tubing was then fired in a kiln at 525° C., resulting in an approximate weight gain of 0.05 mg/mm of tubing length. The beads were formed by sectioning the tubing with a diamond blade on a dicing saw to 2 mm in length and cleaned with several acetone rinses. Chemical analysis of the beads showed an average silver weight of 0.0664 mg/bead. The average surface roughness of these beads was 1.2μ. The beads were dosed with 2.5 mg of mercury using a metered syringe dosing system. The mercury-containing beads were dispensed into lamps via the exhaust tubulation and the lamps were processed. The beads were free to move within the lamp body and the lamps operated normally. Before insertion into the lamps, the beads were dropped multiple times from a height of 10 cm onto a steel plate. The deceleration of the beads caused no mercury loss from the beads when weighed on a scale accurate to 0.1 μg. The beads were weighed and grouped together for an extended period of time and reweighed. No transfer of mercury occurred from bead to bead despite them being stored in bulk.

The maximum amount of mercury that could be held by the beads described immediately above, with respect to the dissolution of silver in mercury at 50° C., is 41.5 mg using a safety factor of two. Since this volume of mercury exceeds the volume of the bore in the bead, the maximum practical dose is regulated by the retention of the mercury in the bead during the transfer from the dosing process to the dispensing process. The minimum amount of mercury that could be dispensed into a lamp is 0.155 mg above the dose required to take the lamp to the end of life.

While two shapes of bead are specifically disclosed herein (i.e., cylindrical and spherical) it should be noted that the tubing shape is not critical. What is required is a body with a recess that can be coated with a material that wets mercury. In this way, a dose of mercury is held in isolation from other doses, even when the beads are in contact with one another. Glass bead or bodies with silver linings are preferred because they are inexpensive, transparent, inert to operation of the lamp, of light weight, commercially available and easy to deliver into the lamp.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. A mercury dispenser for an arc discharge lamp, the mercury dispenser comprising:

a body selected from the group consisting of glass and ceramic materials, the body including a bore, wherein the body has freedom of movement within the arc discharge lamp;

a first material coating the bore, the first material being capable of wetting mercury; and a quantity of mercury in the bore in contact with the first material.

2. A method of dispensing mercury into a fluorescent lamp, comprising:

providing a body selected from the group consisting of glass and ceramic materials;

providing a bore in the body;

providing a first material as a coating in the bore, the first material being capable of wetting mercury;

depositing a quantity of mercury in the bore in contact with the first material;

inserting the body into the fluorescent lamp via a lamp exhaust tubulation;

exhausting and sealing the fluorescent lamp; and processing the fluorescent lamp to activate the fluorescent lamp, wherein upon activation of the fluorescent lamp, the body dispenses mercury.

3. A method of making a mercury dispenser for a device, comprising:

forming a body of material, the material selected from the group consisting of glass and ceramic materials, wherein the body has freedom of movement within the device;

providing a bore in the body;

coating the bore with a mercury wetting material; and dispensing a quantity of mercury into the bore.

4. A fluorescent lamp comprising:

a tubular member having an arc generating and sustaining medium therein;

an electrode at each end of the tubular member;

a phosphor coating on the interior of the tubular member; and a body formed of a material selected from the group of consisting of glass and ceramic materials, the body contained within the tubular member and having freedom of movement within the tubular member, the body having a bore therein, the bore being coated with a mercury wetting material and a quantity of mercury contained within the bore in contact with the mercury wetting material.

5. The mercury dispenser of claim 1, wherein the body includes a first end and a second end, and wherein the bore passes from the first end of the body to the second end of the body, such that mercury may be dispensed from the first end of the body, the second end of the body, or both.

6. The mercury dispenser of claim 1 wherein the first material comprises:

a first material coating the bore, the first material being capable of wetting mercury and being capable of maintaining mercury within the bore when the mercury dispenser comes into contact with another mercury dispenser.

7. The mercury dispenser of claim 6 wherein the first material comprises:

a first material coating the bore, the first material being capable of wetting mercury, the first material having a surface roughness, wherein the surface roughness of the first material is capable of maintaining mercury within the bore when the mercury dispenser comes into contact with another mercury dispenser.

8. The method of claim 2 wherein inserting comprises inserting the body into the fluorescent lamp such that the body has freedom of movement within the fluorescent lamp.

9. The method of claim 2, wherein providing a body comprises:

providing a body selected from the group consisting of glass and ceramic materials, wherein the body includes a first end and a second end;

and wherein a bore comprises:

providing a bore in the body, wherein the bore passes from the first end of the body to the second end of the body;

and wherein processing comprises:

processing the fluorescent lamp to activate the fluorescent lamp, wherein upon activation of the fluorescent lamp, the body dispenses mercury from the first end of the body, the second end of the body, or both.

10. The method of claim 2, wherein providing a bore comprises:

providing a bore in the body, wherein the bore has a surface roughness;

and wherein providing a first material comprises:

providing a first material as a coating in the bore, the first material being capable of wetting mercury, the first material maintaining the surface roughness of the bore;

and wherein the method comprises:

inserting a second body into the fluorescent lamp, wherein the second body has the same characteristics as the body and includes mercury; and maintaining mercury within the bore of the body when the body comes into contact with the second body.

11. The method of claim 3, wherein forming comprises:

forming a body of material, the material selected from the group consisting of glass and ceramic materials, wherein the body has freedom of movement within the device, and wherein the body includes a first end and a second end;

and wherein providing comprises:

providing a bore in the body, wherein the bore passes from the first end of the body to the second end of the body;

and wherein dispensing comprises:

dispensing a quantity of mercury into the bore, such that mercury may be dispensed from the first end of the body, the second end of the body, or both.

12. The method of claim 3 wherein providing comprises:

providing a bore in the body, wherein the bore has a surface roughness;

and wherein coating comprises:

coating the bore with a mercury wetting material, such that the surface roughness of the bore is maintained;

and wherein the method comprises:

maintaining mercury within the bore of the body when the mercury dispenser comes into contact with a second mercury dispenser.

13. The fluorescent lamp of claim 4 wherein the body comprises:

a body formed of a material selected from the group of consisting of glass and ceramic materials, the body contained within the tubular member and having freedom of movement within the tubular member, the body having a bore therein, the bore being coated with a mercury wetting material and a quantity of mercury contained within the bore in contact with the mercury wetting material.

14. The fluorescent lamp of claim 4 wherein the body includes a first end and a second end, and wherein the bore passes from the first end of the body to the second end of the body, such that mercury may be dispensed within the tubular member of the fluorescent lamp from the first end of the body, the second end of the body, or both.

15. The fluorescent lamp of claim 4 wherein the mercury wetting material is capable of maintaining the mercury within the bore when the body comes into contact with another body containing mercury within the fluorescent lamp.

16. The mercury dispenser of claim 15 wherein the first material has a surface roughness capable of maintaining the mercury within the bore when the body comes into contact with another body containing mercury within the fluorescent lamp.

* * * * *